United States Patent [19]

Bearden, Jr. et al.

[11] 4,400,262

[45] Aug. 23, 1983

[54] FLUID COKING WITH THE ADDITION OF POLYMETAPHOSPHORIC ACID CATALYSTS

[75] Inventors: Roby Bearden, Jr.; Robert C. Schucker, both of Baton Rouge, La.

[73] Assignee: Exxon Research and Engineering Co., Florham Park, N.J.

[21] Appl. No.: 380,096

[22] Filed: May 20, 1982

[51] Int. Cl.[3] ..... C10G 1/00; C10G 11/18

[52] U.S. Cl. ..... 208/8 R; 208/127; 201/20; 201/31

[58] Field of Search ..... 208/127, 8 R; 201/20, 201/31

[56] References Cited

U.S. PATENT DOCUMENTS

| | | | |
|---|---|---|---|
| 4,051,016 | 9/1977 | Metrailer et al. | 208/127 |
| 4,160,041 | 9/1979 | Schuette | 208/108 |
| 4,229,283 | 10/1980 | Sosnowski | 208/127 |
| 4,269,696 | 5/1981 | Metrailer | 208/120 |

*Primary Examiner*—Delbert E. Gantz
*Assistant Examiner*—Anthony McFarlane
*Attorney, Agent, or Firm*—Marthe L. Gibbons

[57] ABSTRACT

A fluid coking process is provided in which a polymetaphosphoric acid, a salt of a polymetaphosphoric acid or precursors thereof are present in the fluid coking zone.

11 Claims, 2 Drawing Figures

FLUID COKING WITH THE ADDITION OF POLYMETAPHOSPHORIC ACID CATALYSTS

BACKGROUND OF THE INVENTION

1. Field of the Invention

This invention relates to an improvement in a fluid coking process. More particularly, this invention relates to a fluid coking process conducted in the presence of certain phosphorus-containing inorganic acid catalysts.

2. Description of the Prior Art

Fluid coking is a well known process which may be carried out with or without recycle of the heavier portion of the fluid coking zone effluent. As is well known in the art, the fluid coking process, as shown for example, in U.S. Pat. No. 2,881,130, which is hereby incorporated by reference, uses a fluid coking vessel and an external heating vessel. A fluid bed of solids, preferably coke particles produced by the process having a size in the range from about 40 to about 1000 microns is maintained in the coking zone by the upward passage of fluidizing gas, usually steam, injected at a superficial velocity usually between 0.3 and 5 feet per second. The temperature in the fluid coking bed is maintained in the range of about 850° to about 1400° F., preferably between 900° and 1200° F. by circulating solids (coke) to the heating vessel and back. The heavy oil to be converted is injected into the fluid bed and upon contact with the hot solids undergoes pyrolysis evolving lighter hydrocarbon products in vapor phase, including normally liquid hydrocarbons, and depositing a carbonaceous residue (coke) on the solids. The turbulence of the fluid bed normally results in substantially isothermal reaction conditions and thorough and rapid distribution of the heavy injected oil. The feed rate and temperature are controlled to maintain the bed in a fluidized state. Product vapors, after removal of entrained solids, are withdrawn overhead from the coking zone and sent to a scrubber and fractionator for cooling and separation. The end boiling point of distillate fractions obtained from the process is usually about 1050° F. to about 1200° F. and the remaining heavy ends are usually recycled to extinction.

U.S. Pat. No. 4,269,696 discloses an integrated fluid coking and gasification process in which a solid cracking catalyst is added to the coker chargestock.

U.S. Pat. No. 4,051,016 discloses a fluid coking process in which a relatively large amount of hydrogen sulfide is added to the coker fluidizing gas.

U.S. Pat. Nos. 4,169,041 and 4,229,283 disclose fluid hydrocoking processes in which oil soluble or oil dispersible metal compounds are added to the chargestock of the coker. The added metal compounds may be inorganic heteropoly acids such as phosphomolybdic acid and salts of organic acids. The hydrogen-containing fluidizing gas of the coking zone may also comprise hydrogen sulfide as disclosed in U.S. Pat. No. 4,229,283.

It has now been found that the presence of polymetaphosphoric acids, their salts and derivatives will provide advantages which will become apparent in the ensuing description.

SUMMARY OF THE INVENTION

In accordance with the invention, there is provided, a fluid coking process comprising the steps of: contacting a carbonaceous chargestock with hot fluidized solids in a fluidized bed contained in a coking zone maintained in a fluidized state by the introduction of a fluidizing gas and operated at coking conditions, to produce a vapor phase product and a solid carbonaceous material which deposits on said fluidized solids, the improvement which comprises the presence, in said coking zone, of an effective amount of a phosphorus-containing component selected from the group consisting of polymetaphosphoric acids, salts of polymetaphosphoric acids, precursors of said acids and of said salts, and mixtures thereof.

DESCRIPTION OF THE PREFERRED EMBODIMENT

Figure 1:
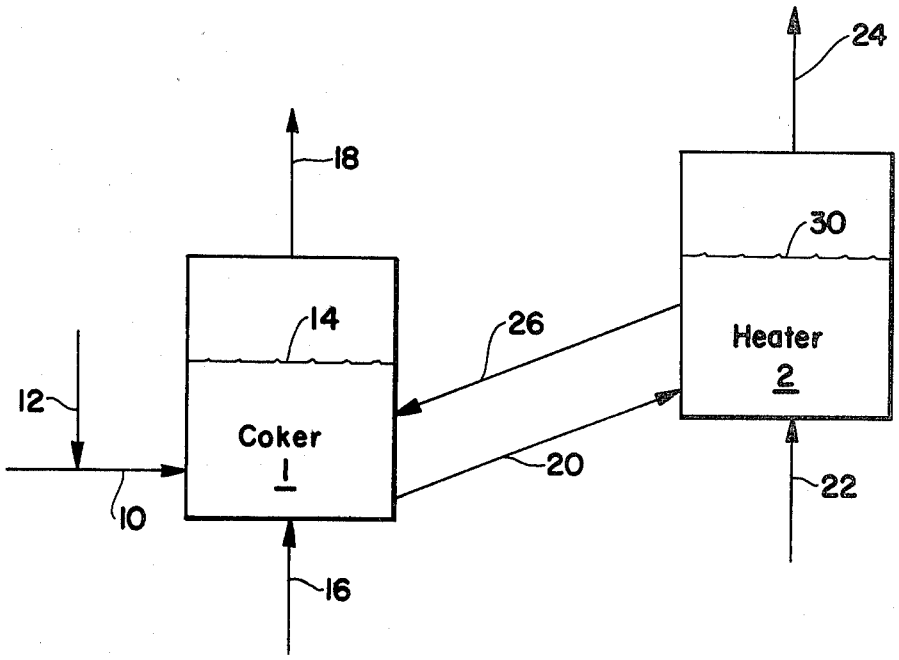
FIG. 1 is a schematic flow plan of one embodiment of the invention.

Referring to FIG. 1, a carbonaceous chargestock having a Conradson carbon content of about 15 weight percent such as heavy residuum having an atmospheric pressure boiling point of about 1050° F.+, is passed by line 10 into a coking zone 1 in which is maintained a fluidized bed of solids (e.g. coke particles of 40 to 1000 microns in size) having an upper level indicated at 14. Above the fluidized bed of solids is a dilute phase.

Suitable carbonaceous chargestocks for the fluid coking stage of the present invention include heavy hydrocarbonaceous oils; heavy and reduced petroleum crudes; petroleum atmospheric distillation bottoms; petroleum vacuum distillation bottoms; pitch; asphalt; bitumen; other heavy hydrocarbon residues; tarsand oil; shale oil; liquid products derived from coal liquefaction processes, including coal liquefaction bottoms; coal; coal slurries, and mixtures thereof. Typically such feeds have a Conradson carbon residue of at least 5 weight percent, generally from about 5 to about 50 weight percent, preferably above about 7 weight percent (as to Conradson carbon residue, see ASTM Test D 189-65).

A phosphorus-containing component selected from the group consisting of polymetaphosphoric acids $(HPO_3)_n$, wherein n may range from about 2 to about 20, precursors of a polymetaphosphoric acid, that is, compounds which will yield a polymetaphosphoric acid under process conditions (e.g. orthophosphoric acid, $H_3PO_4$), or salts of a polymetaphosphoric acid, including partial salts of a polymetaphosphoric acid, is added to the carbonaceous chargestock by line 12. Additionally or alternatively, the phosphorus-containing component, which functions as a catalyst for conversion of the carbonaceous chargestock, may be added directly to the coking zone by recycle of solids or liquid stream. Suitable salts of the polymetaphosphoric acids include the ammonium salts (i.e. ammonium polymetaphosphate) which upon heating decompose to a polymetaphosphoric acid, and partial salts of metals of Groups I, II, IIIA, IVB, VB, VIB, VIIB and VIII of the Periodic Table of Elements and mixtures of these metals, for example, partial salts comprising a cation selected from the group consisting of Na, K, Mg, Ca, Al, Ti, V, Cr, Mn, Ni, Fe and mixtures thereof. By the term "partial salt" with reference to polymetaphosphoric acid is intended herein a salt of a polymetaphosphoric acid in which at least a fraction of the protonic acid groups is not exchanged with a metal cation. The preparation and properties of polymetaphosphoric acids and their corresponding metal salts are described in *Compre-*

*hensive Inorganic Chemistry* edited by Bailar, Emeleus and Nyholm, Chapter 20, Vol. 2, published by Pergamon Press, 1973. The Periodic Table of Elements referred to herein is given in *Handbook of Chemistry and Physics,* published by Chemical Ruber Company, Cleveland, Ohio, 46th Edition, 1964. If desired, the given phosphorus-containing component may be used in combination with other catalytic components, such as, for example, with phosphomolybdic acid or with cracking catalysts of the type disclosed in U.S. Pat. No. 4,269,696, the teachings of which are hereby incorporated by reference. When a polymetaphosphoric acid is utilized as the phosphorus-containing component, it may be added to the carbonaceous feed in dry form or in some cases in an aqueous medium. Furthermore, if desired, the phosphorus-containing component may be composited with a support such as carbon; coke; an inorganic oxide such as silica, alumina, silica-alumina; boria; titania; magnesia; strontia; zirconia and mixtures thereof. A sufficient amount of phosphorus-containing component is added to the carbonaceous chargestock to provide at least about 0.1 weight percent, preferably from about 0.1 to 40 weight percent, more preferably from about 1 to 10 weight percent, calculated as elemental phosphorus, based on the carbonaceous chargestock. When the phosphorus-containing component is added as solid particles, the particles are suitably below about 44 microns in diameter, preferably below about 20 microns in diameter, more preferably below about 5 microns in diameter.

A fluidizing gas is admitted to coker 1 by line 16 in an amount sufficient to maintain a superficial gas velocity in the range of about 0.3 to about 5 feet per second. The fluidizing gas may comprise steam, gaseous hydrocarbons, vaporized normally liquid hydrocarbons, hydrogen, hydrogen sulfide, and mixtures thereof. Preferably, the coking reaction is conducted in the absence of added hydrogen. Typically, the fluidizing gas used will comprise steam. Coke at a temperature above the coking temperature, for example, at a temperature of 100 to 800 Fahrenheit degrees in excess of the actual operating temperature of the coking zone is admitted to coker 1 by line 26 in an amount sufficient to maintain the coking temperature in the range of about 850° to about 1400° F., preferably in the range of about 900° to about 1200° F. The total pressure in the coking zone is maintained in the range of about 0 to about 150 pounds per square inch gauge (psig), preferably in the range of about 5 to about 100 psig. The lower portion of the coker serves as a stripping zone to remove occluded hydrocarbons from the solids. The vaporous products include gaseous hydrocarbons and normally liquid hydrocarbons as well as other gases which are introduced into the coker as fluidizing gas. The vapor phase product is removed from coker 1 by line 18 for scrubbing and fractionation in a conventional way. If desired, at least a portion of the vaporous effluent may be recycled to the coker as fluidizing gas. A stream of heavy material condensed from the vaporous coker effluent may be recycled to the coker or the coker may be operated in a once-through manner, that is, without recycle of the heavy material to the coker.

A stream of stripped coke (commonly called cold coke) is withdrawn from the coker by line 20 and introduced into a fluid bed of hot coke having a level 30 in heater 2. The heater may be operated as a conventional coke burner such as disclosed in U.S. Pat. No. 2,881,130, which is hereby incorporated by reference. When the heater is operated as a burner, an oxygen-containing gas, typically air, is introduced into heater 2 by line 22. The combustion of a portion of the solid carbonaceous deposition on the solids with the oxygen-containing gas provides the heat required to heat the colder particles. The temperature in the heating zone (burning zone) is maintained in the range of about 1200° to about 1700° F. Alternatively, heater 2 can be operated as a heat exchange zone such as disclosed in U.S. Pat. Nos. 3,661,543; 3,702,516 and 3,759,676, the teachings of which are hereby incorporated by reference. Hot coke is removed from the fluidized bed in heater 2 and recycled to the coker by line 26 to supply heat thereto. If desired, a phosphorus-containing component may be recovered from the heating zone or from the gasification zone of an integrated coking and gasification process and the recovered phosphorus-containing component may be recycled to the coker chargestock or dilute phase of the coker, as described in U.S. Pat. No. 4,269,696, the teachings of which are hereby incorporated by reference.

The following example is presented to illustrate the invention.

EXAMPLE 1

Figure 2:
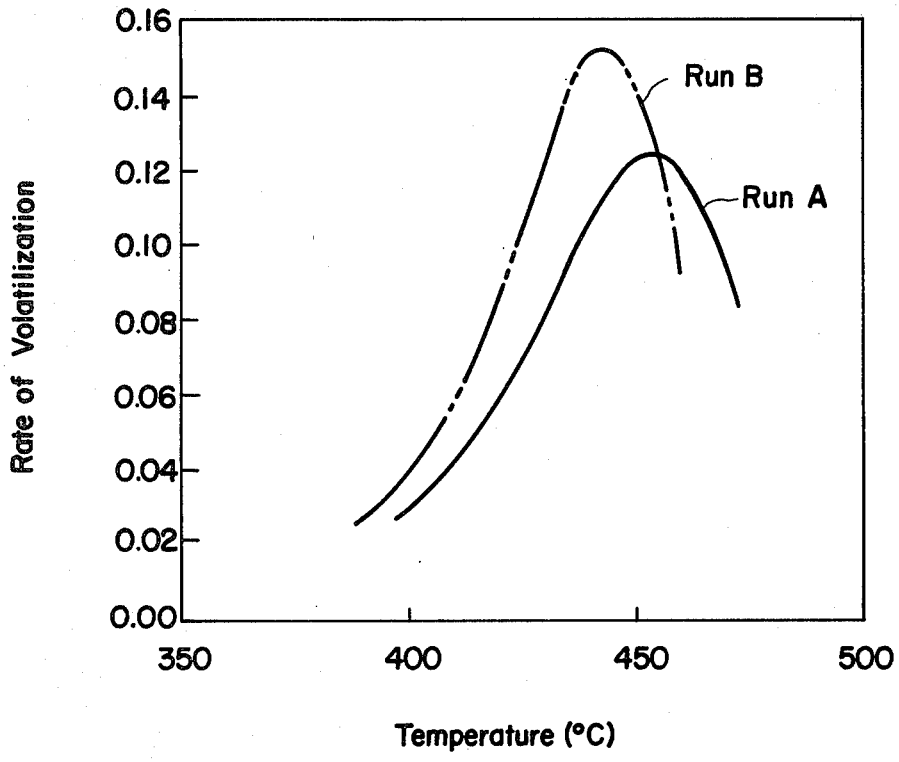
FIG. 2 is a graph showing rate of volatilization of a vacuum residuum versus temperature.

The catalytic activity of a commercially available polymetaphosphoric acid, (supplied as a mixture comprising about $\frac{1}{3}$ $(HPO_3)_n$ and $\frac{2}{3}$ $(NaPO_3)_n$) was measured experimentally using thermogravimetric analysis to simulate the coking environment. A thermal run using no added catalyst, herein designated Run A, was also performed. The feed, in Run B, which was a run in accordance with the present invention, and in Run A was a heavy vacuum residuum having an initial boiling point above 1050° F. at atmospheric pressure and a Conradson carbon content of 26.8 weight percent. Volatile yields were obtained directly from the analyses and are summarized in Table I. In addition, the rate of volatilization was measured directly and shown in FIG. 2.

TABLE I

| Run | Catalyst | Catalyst/Oil (wt./wt.) | Volatile Yield (Wt. % on Feed) |
|---|---|---|---|
| A | None | 0 | 77.6% |
| B | Polymetaphosphoric Acid | 1 | 80.0% |

As can be seen from these experiments, a significant rate increase resulted from the addition of the polymetaphosphoric acid. Not only was the maximum catalytic rate about 20% higher than the maximum thermal rate, but it also occurred at a lower temperature.

What is claimed is:

1. In a fluid coking process comprising the steps of: contacting a carbonaceous chargestock with hot fluidized solids in a fluidized bed contained in a coking zone maintained in a fluidized state by the introduction of a fluidizing gas and operated at coking conditions, to produce a vapor phase product and a solid carbonaceous material which deposits on said fluidized solids, the improvement which comprises the presence, in said coking zone, of an effective amount of a phosphorus-containing component selected from the group consisting of polymetaphosphoric acids, salts of polymetaphosphoric acids, precursors of said acids and of said salts, and mixtures thereof.

2. The process of claim 1 wherein said salts of polymetaphosphoric acids are selected from the group consisting of ammonium salts of polymetaphosphoric acids, partial salts of polymetaphosphoric acids of a metal selected from the group consisting of Groups I, II, IIIA, IVB, VB, VIB, VIIB, and VIII of the Periodic Table of Elements and mixtures thereof.

3. The process of claim 1 wherein said phosphorus-containing component is a polymetaphosphoric acid.

4. The process of claim 1 wherein said phosphorus-containing component is present in said coking zone in an amount of at least about 0.1 weight percent, calculated as elemental phosphorus, based on the weight of said carbonaceous chargestock.

5. The process of claim 1 wherein said phosphorus-containing component is present in said coking zone in an amount ranging from about 0.1 weight percent to about 40 weight percent.

6. The process of claim 1 wherein said phosphorus-containing component is added to said carbonaceous chargestock.

7. The process of claim 1 wherein said coking conditions include a temperature ranging from about 850° to about 1400° F.

8. The process of claim 1 wherein said coking conditions include a temperature ranging from about 900° to about 1200° F.

9. The process of claim 1 wherein said coking conditions include a pressure ranging from about 0 to about 150 psig.

10. The process of claim 1 wherein said carbonaceous chargestock comprises a heavy hydrocarbonaceous oil.

11. The process of claim 1 wherein said carbonaceous chargestock comprises coal.

* * * * *